US012203682B2

(12) United States Patent
Watteau et al.

(10) Patent No.: US 12,203,682 B2
(45) Date of Patent: Jan. 21, 2025

(54) TANKLESS WATER HEATER CONNECTOR

(71) Applicant: Rheem Manufacturing Company, Atlanta, GA (US)

(72) Inventors: Tristin Watteau, Auburn, AL (US); Govinda Mahajan, Pike Road, AL (US); Prudhvi Amaravadhi, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 170 days.

(21) Appl. No.: 17/978,008

(22) Filed: Oct. 31, 2022

(65) Prior Publication Data

US 2023/0050638 A1 Feb. 16, 2023

Related U.S. Application Data

(62) Division of application No. 17/074,973, filed on Oct. 20, 2020, now Pat. No. 11,512,872.

(51) Int. Cl.
*F24H 1/00* (2022.01)
*F23J 13/04* (2006.01)
(Continued)

(52) U.S. Cl.
CPC ..... *F24H 1/0036* (2013.01); *F23J 13/04* (2013.01); *F24H 9/0005* (2013.01); *F24H 1/10* (2013.01); *F24H 1/107* (2013.01)

(58) Field of Classification Search
CPC ..... F24H 1/0036; F24H 1/10; F24H 9/0005
See application file for complete search history.

(56) References Cited

U.S. PATENT DOCUMENTS 822,756 A 6/1906 Needham
836,590 A 11/1906 Le Sauvage
(Continued)

FOREIGN PATENT DOCUMENTS

CN 203615570 U 5/2014
GB 2551749 A * 1/2018 ..... F23L 1/00
(Continued)

OTHER PUBLICATIONS

International Search Report and Written Opinion for PCT Application No. PCT/US2021/055533 mailed Jan. 27, 2022.

*Primary Examiner* — Steven S Anderson, II
(74) *Attorney, Agent, or Firm* — Eversheds Sutherland (US) LLP

(57) ABSTRACT

Disclosed herein are connectors for a tankless water heater. The connectors can comprise a flange, an aperture extending through the flange having a first diameter, one or more slots extending through the flange, a connector portion substantially surrounding the aperture and extending outward from the flange away from the tankless water heater. The aperture can correspond to an air inlet extending into the tankless water heater, and the air inlet can have a second diameter that is larger than the aperture. To keep the flange in place, the one or more slots can correspond to one or more fastening holes in the tankless water heater. The one or more slots can be substantially parallel and on opposite sides of the aperture. The connector can be in a secured state when the one or more slots are fastened to the one or more fastening holes.

12 Claims, 13 Drawing Sheets

(51) Int. Cl.
*F24H 9/00* (2022.01)
*F24H 1/10* (2022.01)

(56) References Cited

U.S. PATENT DOCUMENTS

| | | | | |
|---|---|---|---|---|
| 979,652 | A | 12/1910 | Church | |
| 1,474,995 | A | 11/1923 | Burroughs | |
| 1,870,274 | A | 8/1932 | Otto et al. | |
| 4,261,325 | A * | 4/1981 | Duncan | F24B 13/00 126/307 R |
| 4,584,986 | A | 4/1986 | Cannata | |
| 5,005,555 | A * | 4/1991 | Vogelzang | F24B 1/02 126/289 |
| 5,564,756 | A | 10/1996 | Hamilton | |
| 5,961,155 | A | 10/1999 | Youngs | |
| 6,158,782 | A | 12/2000 | Stanley et al. | |
| 7,874,287 | B1 | 1/2011 | Freden | |
| 2008/0018103 | A1 | 1/2008 | Laib | |
| 2012/0180737 | A1* | 7/2012 | English | F24H 9/0031 122/18.31 |
| 2012/0272928 | A1* | 11/2012 | Kameyama | F24H 8/00 285/332 |
| 2013/0187376 | A1 | 7/2013 | Williams | |
| 2014/0034046 | A1 | 2/2014 | Warmuth et al. | |
| 2016/0003475 | A1* | 1/2016 | Pestoor | F16L 25/14 126/317 |
| 2017/0356646 | A1 | 12/2017 | Leung et al. | |
| 2018/0030997 | A1* | 2/2018 | Post | F04D 25/06 |
| 2019/0017701 | A1* | 1/2019 | Aoki | F23J 13/04 |
| 2020/0033011 | A1* | 1/2020 | Deal | F24D 19/08 |

FOREIGN PATENT DOCUMENTS

| | | | |
|---|---|---|---|
| RU | 168562 | U1 | 2/2017 |
| SU | 821863 | A1 | 4/1981 |

* cited by examiner

TANKLESS WATER HEATER CONNECTOR

CROSS-REFERENCE TO RELATED APPLICATIONS

This application is a divisional of application Ser. No. 17/074,973, filed Oct. 20, 2020, which is incorporated herein by reference.

FIELD OF THE DISCLOSURE

The present disclosure relates generally to tankless water heaters and, in particular, to connectors for tankless water heaters.

BACKGROUND

Recent water heater designs have reduced the need for a large storage tank and heat the water only when heated water is demanded. These on-demand water heaters, also known as "instantaneous" or "tankless" water heaters, typically supply heat only when required, which can reduce the amount of energy lost by the water heating system when the water heater is not in use. These tankless water heaters are commonly used in residential and commercial applications to heat water. Because on-demand water heaters do not require a large storage tank, they can be considerably smaller than traditional water heaters. The reduced size allows on-demand water heaters to be placed closer to where the heated water is needed and further reduces heat loss from water traveling through cold pipes. Because traditional energy sources, like combustible matter and electrical heating elements, are generally known to heat water quicker than a heat pump, existing on-demand water heaters typically use combustible matter or electrical heating elements.

Due to the variety of available tankless water heaters, and their common uses in residential and commercial applications, it is rare to find two tankless water heaters that are alike in terms of size, fitment, capacity, and other parameters. As such, difficulties can arise when replacing, swapping, or maintaining a tankless water heater. Refitting various pipes in a home (e.g., air pipes for venting a tankless water heater) to accommodate a new tankless water heater can be costly and create several plumbing and/or structural issues. If an exhaust vent is needed to accompany a tankless water heater, users must remove and/or drastically alter existing vent lengths and/or install new vents to accommodate a new, dissimilar tankless water heater due to inconsistencies in vent spacing. As such, users of tankless water heaters can become limited in their selections of new tankless water heaters based on the fitment of their current tankless water heater.

What is needed, therefore, are connectors for tankless water heaters that can allow for a seamless connection with existing water plumbing systems of any size, shape, form, and/or fitment. The present disclosure addresses this need as well as other needs that will become apparent upon reading the description below in conjunction with the drawings.

BRIEF SUMMARY

The present disclosure relates generally to tankless water heaters and, in particular, to connectors for tankless water heaters. The disclosed technology can include a connector for a tankless water heater, the connector comprising a flange, a aperture extending through the flange, one or more slots extending through the flange, and a connector portion substantially surrounding the aperture and extending outward from the flange away from the tankless water heater. The connector portion can be configured to attach to and seal with a vent for the tankless water heater.

The aperture can correspond to an air inlet extending into the tankless water heater. The aperture and the air inlet can have a first and a second diameter, respectively. The first diameter can be less than or equal to the second diameter. That is, the diameter of the connector's aperture can be less than or equal to the diameter of the air inlet.

The flange can have one or more slots extending through the flange. The one or more slots can be substantially parallel and on opposite sides of the aperture. Each of the one or more slots can correspond to one or more fastening holes in the tankless water heater. Each of the one or more slots can have a width to accommodate a fastener to fasten the flange to the tankless water heater. The connector can further comprise a gasket disposed between the flange and the tankless water heater.

The connector can be in an unsecured state when the one or more slots are not fastened to the one or more fastening holes, and the one or more slots can allow the flange to move laterally along the tankless water heater in the unsecured state. The connector can be in a secured state when the one or more slots are fastened to the one or more fastening holes.

The present disclosure can also provide a connector for a tankless water heater, the connector comprising: a cover plate, a connector member, and a bracing panel. The cover plate can have an aperture with a first diameter, the tankless water heater can have an air inlet with a second diameter, and the bracing panel can have a third aperture with a third diameter. The first diameter can be less than or equal to the second diameter, and the third diameter can be substantially similar to the first diameter. The connector member can fit within the aperture and extend between the aperture and the air inlet. The connector can also have an adhesive layer disposed between the cover plate and the tankless water heater. The adhesive layer can have a coefficient of friction to prevent the cover plate from moving when the cover plate contacts the adhesive layer.

The connector member can have a bottom portion and a top portion. The connector member can attach to the bracing panel at the bottom portion and attaches to the cover plate at the top portion. The top portion and the bottom portion of the connector member each have a raised lip to retain the cover plate and the bracing panel, respectively.

The connector can be in an unsecured state when the cover plate is not engaged with the adhesive layer. The connector member can allow the flange to move radially within the air inlet in the unsecured state. The connector can also be in a secured state when the cover plate is pressed against the adhesive layer, thereby preventing the cover plate from moving.

Also disclosed herein are tankless water heaters implementing the same.

These and other aspects of the present disclosure are described in the Detailed Description below and the accompanying figures. Other aspects and features of examples of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various examples of the disclosure discussed herein. In similar fashion, while examples may be discussed below as device, system, or method examples, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1:
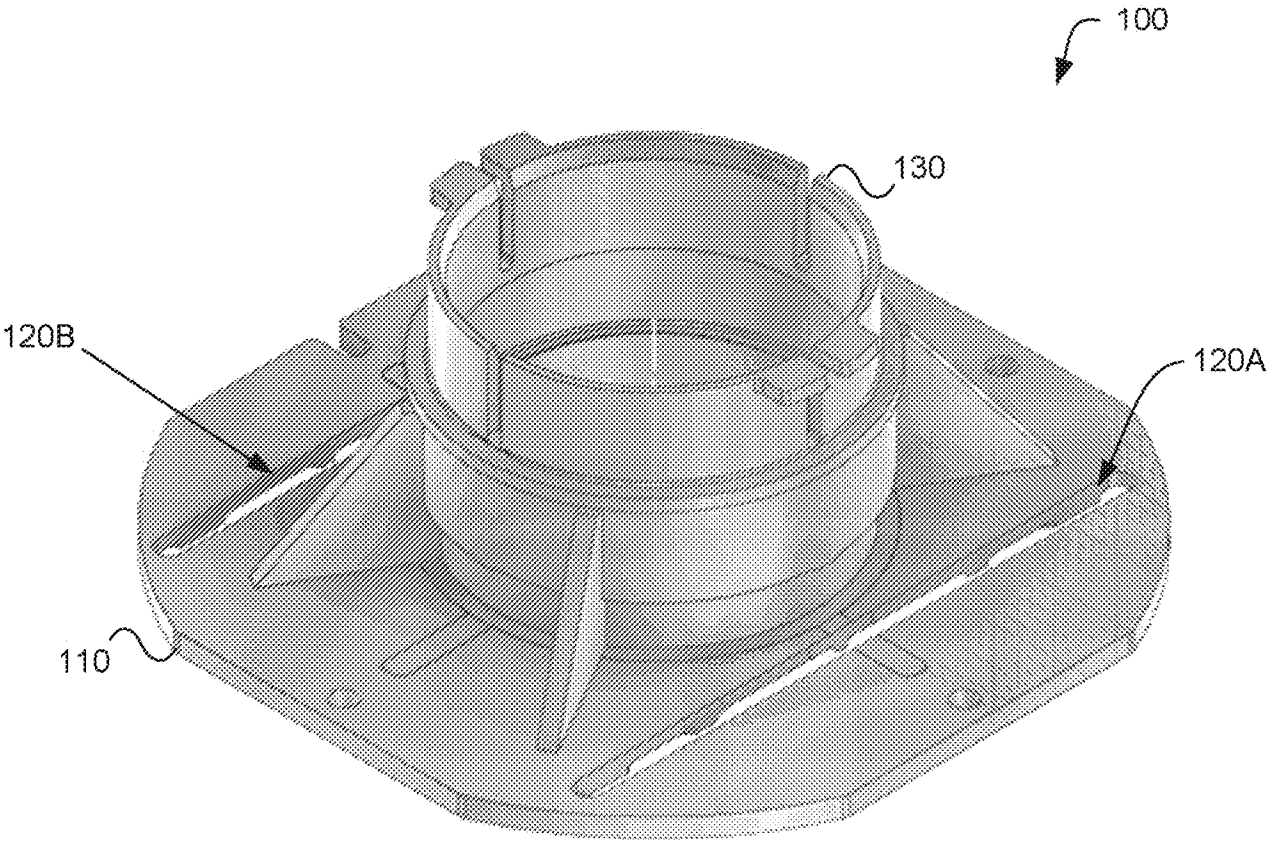
FIG. 1 illustrates a perspective view of an example connector for a tankless water heater, in accordance with the present disclosure.

As described above, a problem with current tankless water heaters is that it is rare to find two tankless water heaters that are alike in terms of size, fitment, capacity, and other parameters. As such, difficulties can arise when replacing, swapping, or maintaining a tankless water heater, often times causing the installer to go through costly and/or laborious processes of running new plumbing, venting, pipes, and the like. It would be beneficial, therefore, to provide connectors for tankless water heaters that have additional customizability to accommodate the various existing tankless water heater systems without needing to alter existing piping.

Disclosed herein are adaptive vent connectors for tankless water heaters that can facilitate the respective connections of an existing inlet duct or conduit and an exhaust duct or conduit to the air inlet and exhaust outlet of several different makes and models of water heaters (e.g., tankless water heaters). As described more fully herein, the disclosed vent connectors are maneuverable to compensate for different distances between the air inlet and exhaust outlet of different water heater manufacturers and/or different water models.

Although certain examples of the disclosure are explained in detail, it is to be understood that other examples and applications are contemplated. Accordingly, it is not intended that the disclosure is limited in its scope to the details of construction and arrangement of components set forth in the following description or illustrated in the drawings. Other examples of the disclosure are capable of being practiced or carried out in various ways. Also, in describing the disclosed technology, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

Reference will now be made in detail to examples of the disclosed technology, some of which are illustrated in the accompanying drawings. Wherever convenient, the same references numbers will be used throughout the drawings to refer to the same or like parts.

Figure 2:
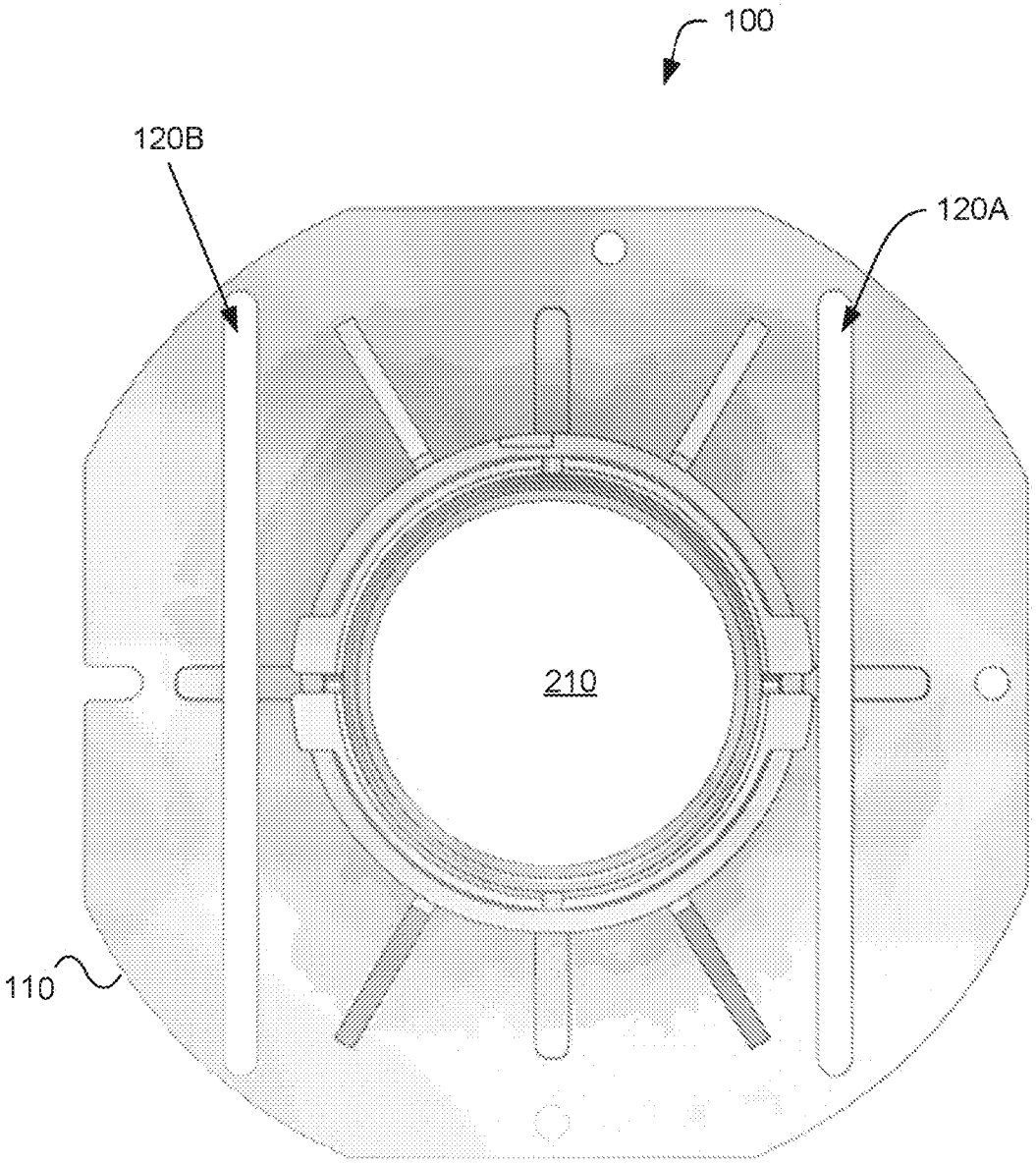
FIG. 2 illustrates a top-down view of an example connector for a tankless water heater, in accordance with the present disclosure.

FIG. 1 and FIG. 2 show a connector 100 for a tankless water heater. The connectors can be used to connect an air inlet on the water heater cabinet to an existing air duct installed in a building. The connectors disclosed herein can form an adjustable connection (e.g., airtight seal, substantially airtight seal, non-airtight seal) with the water heater cabinet and, in turn, with an existing air duct. In other words, the connectors can be moved or repositioned or adjusted to accommodate an existing pair of air ducts while maintaining a connection with the water heater. Further, it should be noted that, while the disclosed connectors are described herein as being configured to connect the water heater's air inlet to an inlet duct, it is contemplated that the disclosed connectors can be configured to connect the water heater's exhaust outlet to an exhaust duct.

The connector 100 can include a flange 110 having a substantially flat bottom surface, an aperture 210 extending through the flange 110 (visible in FIG. 2), one or more slots (e.g., slots 120) extending through the flange 110, and a connector portion 130 configured to attach or otherwise connect to a duct or conduit. The aperture 210 can be substantially circular. Optionally, the aperture 210 can be located at or near the center of the flange 110. The connector portion 130 can have a generally cylindrical shape (e.g., a cylindrical inner shape) and can substantially surround the aperture 210. The connector portion 130 can extend outwardly from the top of the flange 110. The connector portion 130 can have other shapes such that the connector portion 130 can connect to a corresponding duct or conduit.

When installed on a tankless water heater, the aperture 210 can align with and/or correspond to the air inlet (e.g., an aperture in the water heater for receiving air) of the tankless water heater. The diameter of the aperture 210 can be less than or equal to the diameter of the air inlet. In such a manner, the smaller aperture 210 can funnel the air inlet into a smaller diameter to connect the tankless water heater to other components via the connector portion 130. For instance, the first diameter can funnel fluid in the tankless water heater out of the air inlet and into the connector portion to connect with a vent. Alternatively, the diameter of the aperture 210 can be greater than or equal to the diameter of the air inlet. The larger aperture 210 can, for example, help ensure overlap with the air inlet as the connector 100 is realigned or repositioned. The connector 100 can also include a gasket or sealing material (e.g., on the bottom surface of the flange 110) to form a substantially fluid-tight seal between the connector 100 and the tankless water heater. The gasket or sealing material can be placed between the flange 110 and the tankless water heater.

The one or more slots 120 can be opposite one another in the flange 110. The one or more slots 120 can also be parallel to each other. Such a configuration of the one or more slots 120 can increase the stability of the connector 100 and improve the effectiveness of the attachment to a tankless water heater. For similar reasons, the one or more slots 120 can line up with fastening holes in the tankless water heater. Therefore, each of the one or more slots 120 can have a width to accommodate a fastener that can connect to the fastening holes through each of the one or more slots 120. The fastener can fasten the flange to the tankless water heater. For example, the fasteners can be screws, bolts, rivets, nails, and the like. The distance between opposing slots 120 and/or the length of a given slot 120 can be configured to accommodate a large number of makes and/or models of water heater.

It is understood that other configurations of the one or more slots 120 are possible and contemplated so long as the slots in the flange 110 line up with fastening holes in the tankless water heater. For example, any number of slots can be present in the flange 110, such as one, two (as shown), three, four, five, or more. The slots can also be adjacent to each other rather than on opposite sides of the flange 110, and the slots need not be parallel. For example, the one or more slots 120 can be on adjacent sides of the flange 110, or the one or more slots 120 can be on opposing sides but non-parallel.

When the one or more slots 120 line up with respective fastening holes in the tankless water heater, the connector 100 can have an unsecured state and a secured state. In the unsecured state, the one or more slots 120 are not fastened to the fastening holes (e.g., fasteners are not present or are not tightened down). In such a manner, the one or more slots 120 can allow the whole connector 100 to slide laterally along the surface of the tankless water heater. Therefore, a user installing the connector 100 can leave one or more slots 120 unfastened or untightened to properly align the connector 100 before fully fastening the connector 100 and causing the connector 100 to transition into the secured state. In the secured state, the one or more slots 120 can be fastened to the tankless water heater such that lateral movement is prevented.

The connector portion 130 can be configured to connect to a duct, vent, or piping by overlapping the duct, venting, or piping. Alternatively, the connector portion 130 can be configured to be overlapped by the duct, vent, or piping. That is, the connector portion 130 can be have an external diameter that is less than or approximately equal to an internal diameter of the duct, vent, or piping (i.e., the connector portion 130 can overlap the duct, vent, or piping), or the connector portion 130 can have an internal diameter that is approximately equal to or greater than an outer diameter of the duct, vent, or piping (i.e., the connector portion 130 can be overlapped by the duct, vent, or piping). In either case, the connector portion 130 can be attached to the duct, vent, or piping via a vent clamp or other attachment mechanism.

Also as shown, the connector portion 130 can have an upper lip on a far end of the connector portion 130 that is distal the flange 110. The upper lip can aid in attaching the connector portion 130 to existing piping and/or ventilation for the tankless water heater. The upper lip can provide anchor points for hardware to attach. For example, the upper lip can be an attachment point for turn-key clamps, vent clamps, and the like. The upper lip can also include screw threading to attach to a threaded pipe, and/or the upper lip can be sized to provide an interference fit with an external pipe. Alternatively, or additionally, the upper lip can be sized to provide a friction fit and/or interference fit for attaching the connector portion 130 to external piping.

The connector 100 can be made from any material, such a metal or a plastic. For example, the connector 100 can be made from stainless steel or polyvinylchloride (PVC). The flange 110 can also be cut in a variety of shapes and sizes so long as the aperture 210 can fit with the corresponding air inlet on the tankless water heater. The gasket can be made from rubber, flexible plastic, or another material that can provide a watertight and/or airtight seal between the connector 100 and the tankless water heater.

Figure 3A:
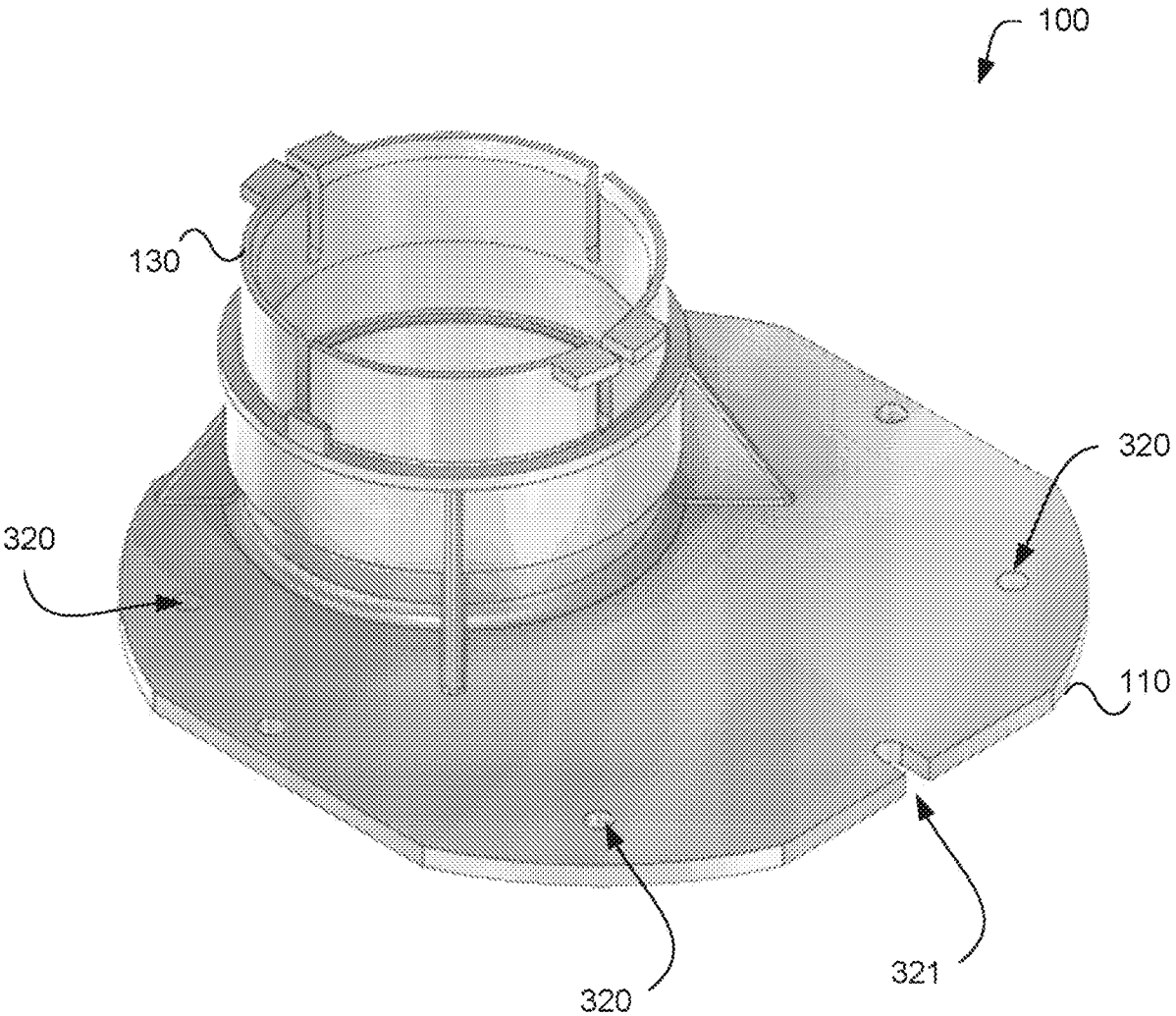
FIG. 3A illustrates a perspective view of another example connector for a tankless water heater, in accordance with the present disclosure.

As shown in FIG. 3A, rather than the one or more slots 120, the flange 110 can have any number of fastening holes 320 and/or fastening slots 321. As will be appreciated, more fastening holes 320 and/or fastening slots 321 can increase the robustness of attachment to the tankless water heater, while fewer fastening holes can reduce manufacturing costs. As such, the disclosed technology can include more or fewer fastening holes and/or fastening than those expressly shown in the drawings.

Figure 3B:
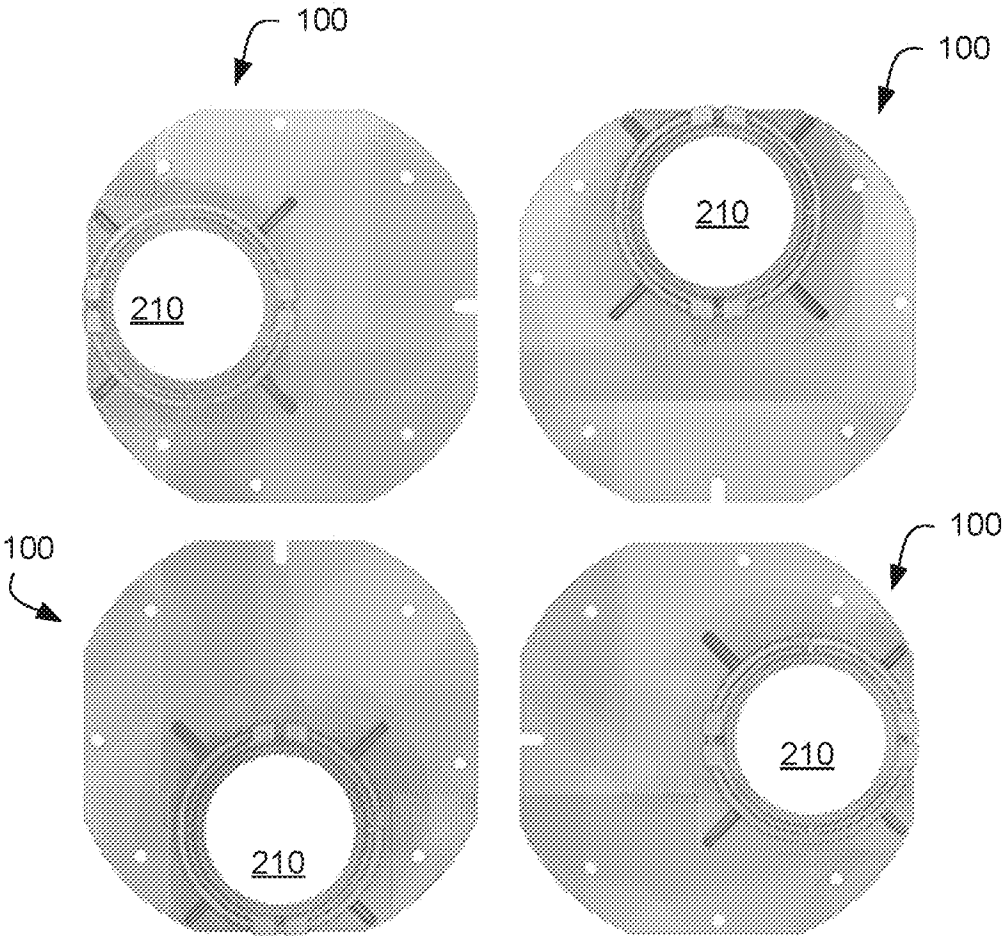
FIG. 3B illustrates a top-down view of the connector of FIG. 3A in various orientations, in accordance with the present disclosure.

Additionally, the aperture 210 can be offset from the center of the flange 110 such that the aperture 210 and the flange 110 do not share a common central axis (i.e., the center of the aperture 210 and/or the protruding portion 130 is/are offset from the center of the flange 110). Alternatively, the aperture 210 can be concentric with the flange 110, as shown in FIGS. 1 and 2. If the aperture 210 is offset, the connector 100 can be rotated in various orientations to accommodate the specific location of the air inlet in the tankless water heater, as shown in FIG. 3B. Because the first diameter of the aperture 210 can be less than or equal to the diameter of the air inlet, the aperture and the air inlet need not be concentric so long as an outer edge of the aperture 210 is within an outer edge of the air inlet.

Figure 3C:
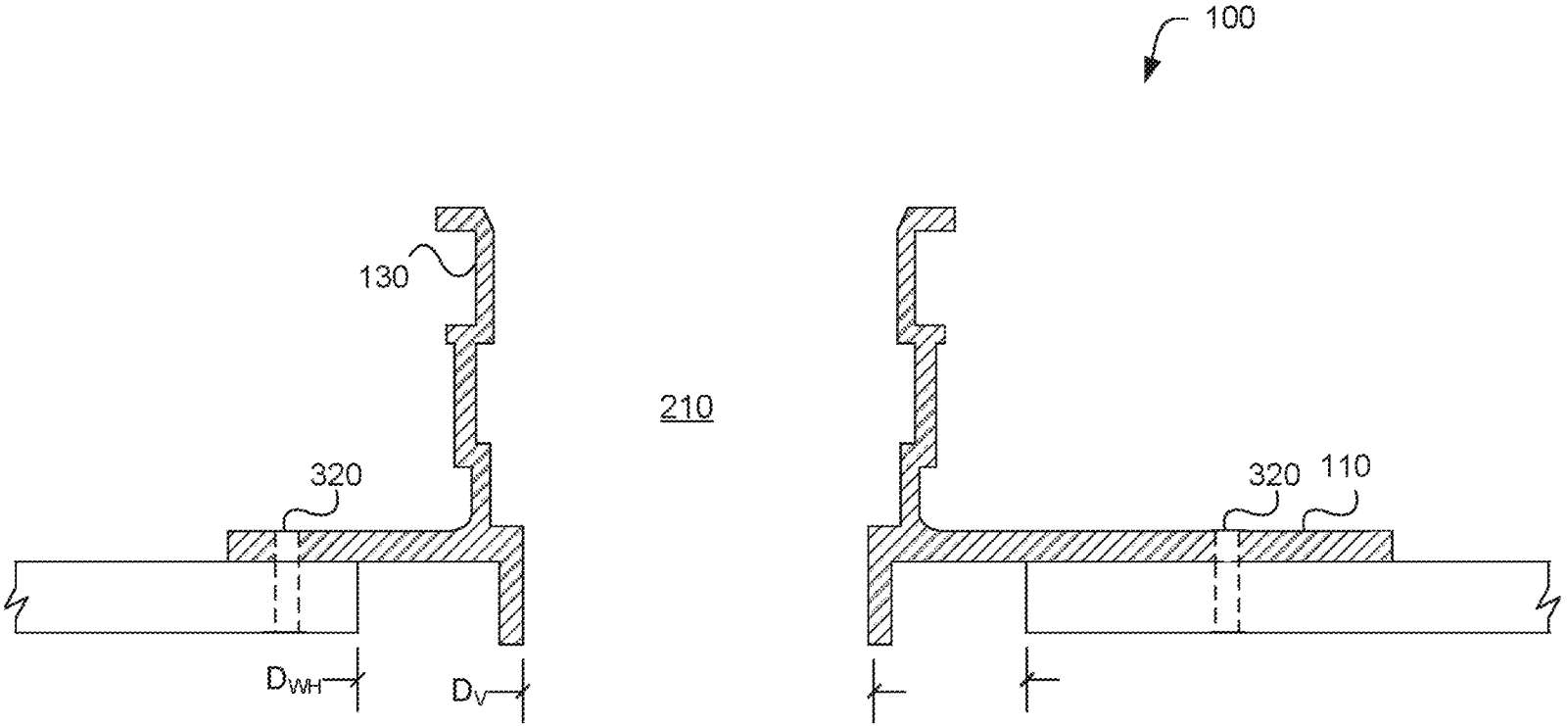
FIG. 3C illustrates a cross-sectional view of the connector of FIG. 3A, in accordance with the present disclosure.

As shown in FIG. 3C, the diameter of the aperture 210, shown as Dv, is less than the diameter of the air inlet, shown as $D_{WH}$. Therefore, the aperture 210 has a large clearance to accommodate air inlets of various sizes and positions. The vent can be translated laterally in FIG. 3C such that the aperture 210 can align with existing piping and/or venting while still remaining within the $D_{WH}$.

Figure 4:
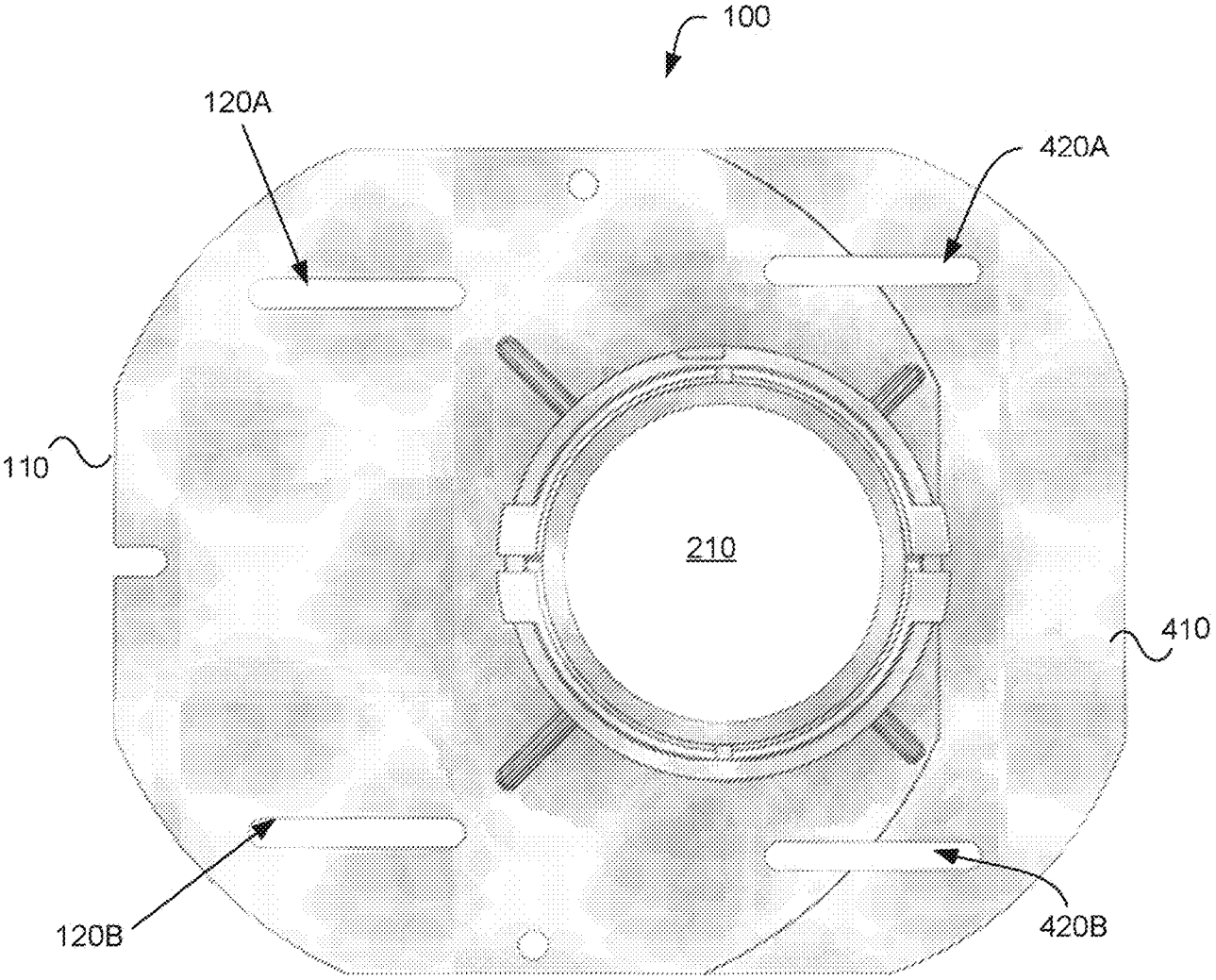
FIG. 4 illustrates a top-down view of another example connector for a tankless water heater in accordance with the present disclosure.

As shown in FIG. 4, the connector 100 can include a slideable or extendable flange portion 410 attached to the flange 110. The extendable flange 410 can also have two extension slots 420A and 420B. The flange 110 can be configured to slide laterally with respect to the extendable flange 410. The flanges can be designed such that, when the extendable flange 410 is laterally extended, there are no exposed gaps beyond the flange itself. For instance, the two extension slots 420A and 420B can be sized such that a gap cannot form when the extendable flange 410 is laterally extended.

The two extension slots 420A and 420B can be opposite one another in the extendable flange 410. The two extension slots 420A and 420B can also be parallel to each other. The two extension slots 420A and 420B can line up with the fastening holes in the tankless water heater and can have a width to accommodate a fastener that can connect to the fastening holes through each of the two extension slots 420A and 420B. The fastener can fasten the flange 110 to the extendable flange 410 and then further fasten both to the tankless water heater.

In the unsecured state, the one or more slots 120 are not tightly fastened to the tankless water heater, and the two extension slots 420A and 420B are not tightly fastened to the flange 110 (e.g., fasteners are not present or are not tightened down). In such a manner, the two extension slots 420A and 420B can allow the flange 110 to slide laterally along the extendable flange 410. Therefore, a user installing the connector 100 can attach the extendable flange 410 (via the two extension slots 420A and 420B) while leaving the one or more slots 120 unfastened to properly align the connector 100 before fastening the connector 100 in the secured state. In the secured state, the one or more slots 120 can be fastened to the tankless water heater and to the extendable flange 410 such that lateral movement is prevented.

FIGS. 5A-5D illustrate another connector 500 for a tankless water heater. The connector 500 can have a cover plate 510, a connector member 520, and a bracing panel 530. The cover plate 510 can have a generally frustoconical shape or any other shape such that a lower hole or aperture 512 (i.e., connected to cover an air inlet of a water heater) of the cover plate 510 is larger than an upper hole or aperture 514 (i.e., configured to connect to the connector member 520) of the cover plate 510. The lower hole 512 can have a diameter that is larger than the diameter of the air inlet such that the cover plate 510 can be maneuvered side-to-side and forward-to-back while still covering or substantially covering the air inlet.

The connector member 520 can have an external diameter that is less than or approximately equal to the internal diameter of the upper hole 514 of the cover plate 510 such that the connector member 520 can fit within the upper hole 514 and can extend through the cover plate and to or into the air inlet. The connector member 520 can also have a top portion 522 and a bottom portion 524. The top portion 522 and the bottom portion 524 can correspond to the upper hole 514 and the air inlet, respectively. The top portion 522 can include a raised lip to aid in the attachment the cover plate 510 and/or a duct, vent, or pipe, such as described above. The bottom portion can include a step 528 that includes a step surface extending substantially radially outward. As described more fully herein, the step 528 can be configured to secure the connector member 520 to the bracing panel 530 and thereby secure the connector 500 to the water heater. To that end, the connector member 520 can have a lower portion diameter that is less than a step diameter of the step 528. As shown, the step 528 can include a sloped wall that slopes radially inwardly below the step surface. The connector member 520 can also include one or more vertical notches 526.

The bracing panel 530 can include an aperture 532 having a diameter substantially similar to the lower portion diameter of the connector member 520 and is less than the step diameter of the notch. The bracing panel 530 can be configured to be positioned within the tankless water heater and abut an interior surface of the tankless water heater proximate the air inlet. In such a manner, the bracing panel 530 and the cover plate 510 can sandwich a wall of the tankless water heater to secure the connector 500 to the water heater. The connector member 520 can extend from an attachment point to a duct, vent, or pipe, through the upper and lower holes of the cover plate 510, through the air inlet aperture of the water heater, and through the aperture 532 of the bracing panel 530. The bottom portion 524 of the connector member 520 can also attach to the bracing panel 530 via the notch. With the bracing panel 530 located within the water heater at the air inlet, the connector member 520 (e.g., with the cover plate 530 already attached) can be inserted into the air inlet and into the aperture 532 of the bracing panel 530. As the lower portion 524 of the connector member 520 is inserted, the sloped surface of the step 528 comes into contact with the aperture 532 of the bracing panel 530, and the difference in diameters, along with the one or more vertical notches 526, permits the lower portion of the connector member 520 to bend or compress inwardly such that the step 528 can pass through the aperture 532 of the bracing panel 530. Once the step 528 has passed through the aperture 532 of the bracing panel 530, the lower portion of the connector member can return to its original shape and dimension such that the step surface of the connector member's 520 step can abut a lower surface of the bracing panel 530 proximate the aperture 532, thereby retaining the connector member 520 with respect to the bracing panel 530 and securing the connector 510 with respect to the water heater.

Figure 5A:
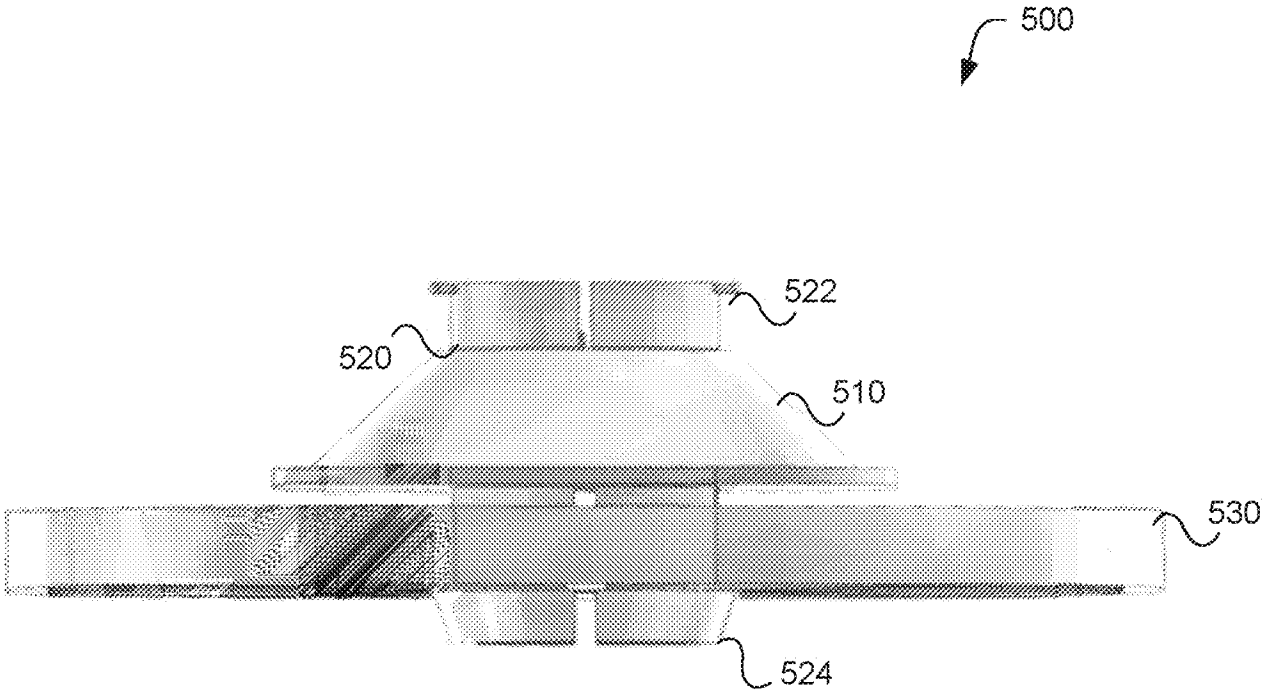
FIG. 5A illustrates a side view of another example connector for a tankless water heater, in accordance with the present disclosure.
Figure 5B:
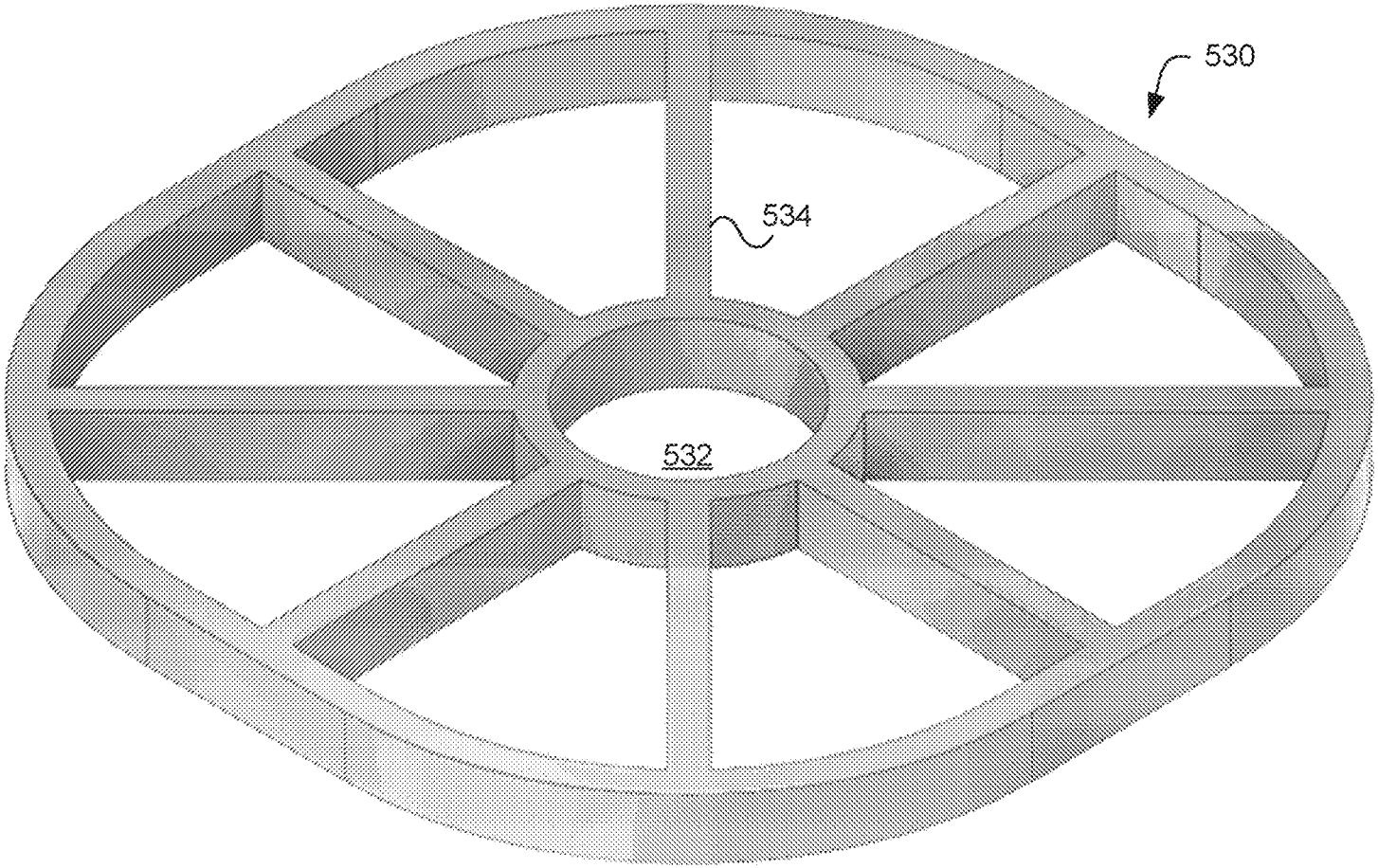
FIG. 5B illustrates a perspective view of an example bracing panel for a connector for a tankless water heater, in accordance with the present disclosure.
Figure 5C:
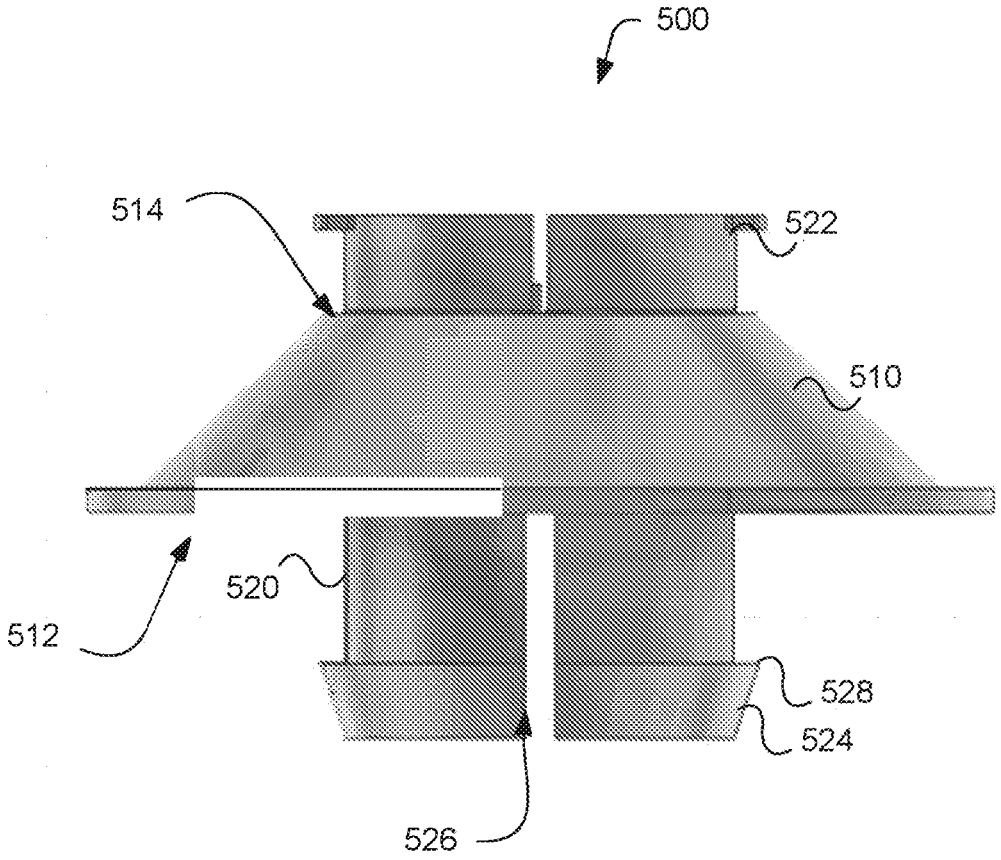
FIG. 5C illustrates a side view of an example connector member for a connector for a tankless water heater, in accordance with the present disclosure.
Figure 5D:
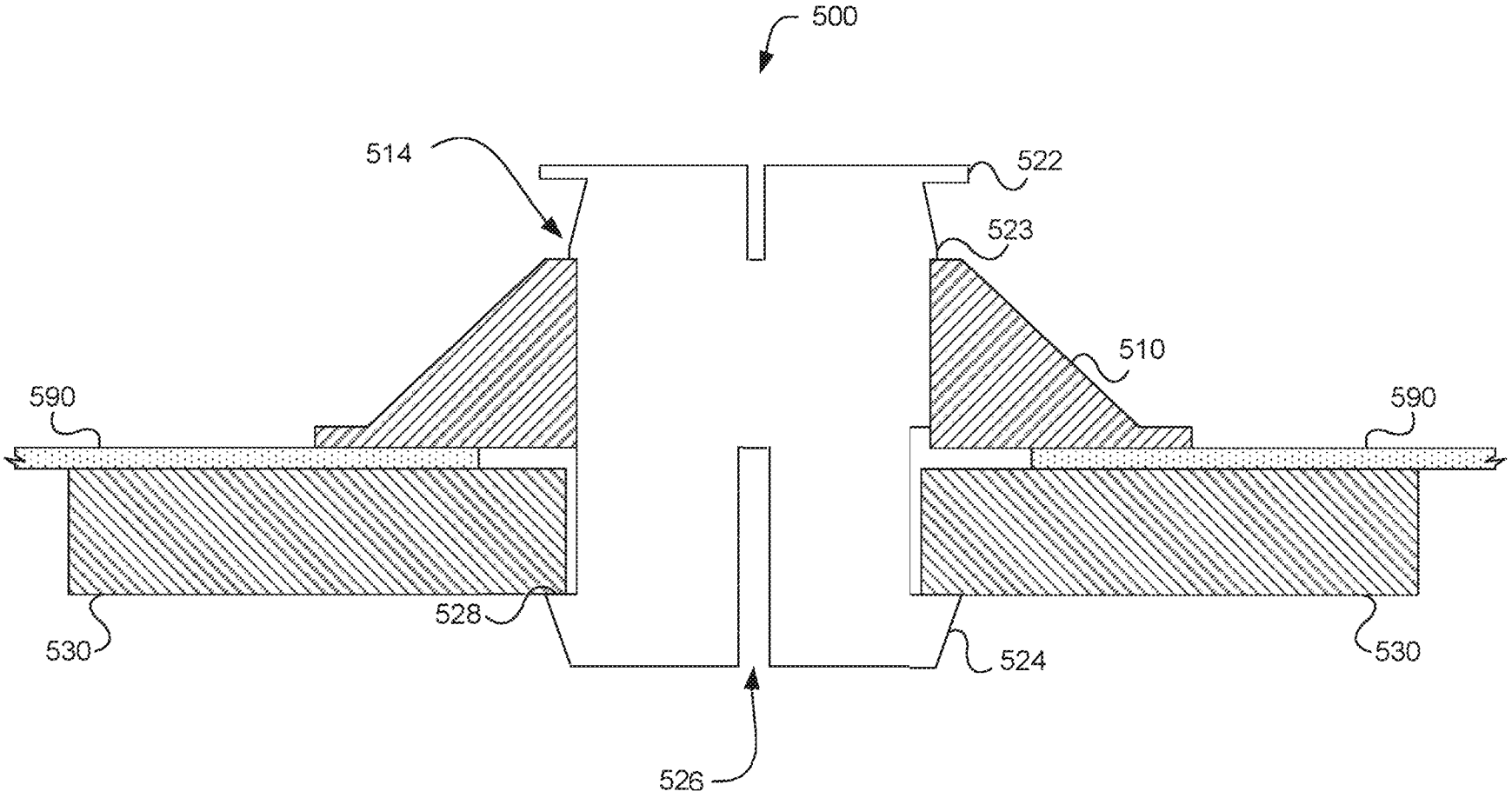
FIG. 5D illustrates a cross-sectional view of an example connector attached to a tankless water heater, in accordance with the present disclosure.

As shown most clearly in FIG. 5D, when the connector member 520 is attached to the bracing panel 530, the connector 500 can sandwich the external wall of the water heater (e.g., the exterior wall of the top portion of the water heater). That is, when the step 528 of the connector member 520 is abutting the lower surface of the bracing panel 530, the top surface of the bracing panel 530 can abut the interior surface of the water heater panel 590 (e.g., the top of the water heater). In so doing, the connector member 520 and the bracing panel 530 can connect the connector 500 to the water heater panel 590. Optionally, the connector member 520 can include an upper step 523 configured to abut a top surface of the cover plate 510. The cover plate 510, connector member 520, and/or bracing panel 530 can be sized such that, when the connector 500 is attached to the water heater panel 590, the cover plate's 510 top surface abuts the upper step 523, which can help maintain a connection of the cover plate's 510 bottom surface to the exterior of the water heater panel 590. Alternatively or in addition, the bracing panel 530 can comprise and/or be made from a compressible material (e.g., a plastic, rubber, etc.) that can compress and/or deform such that the connector 500 can be attached to different water heater panels 590 of varying thicknesses.

Figure 5E:
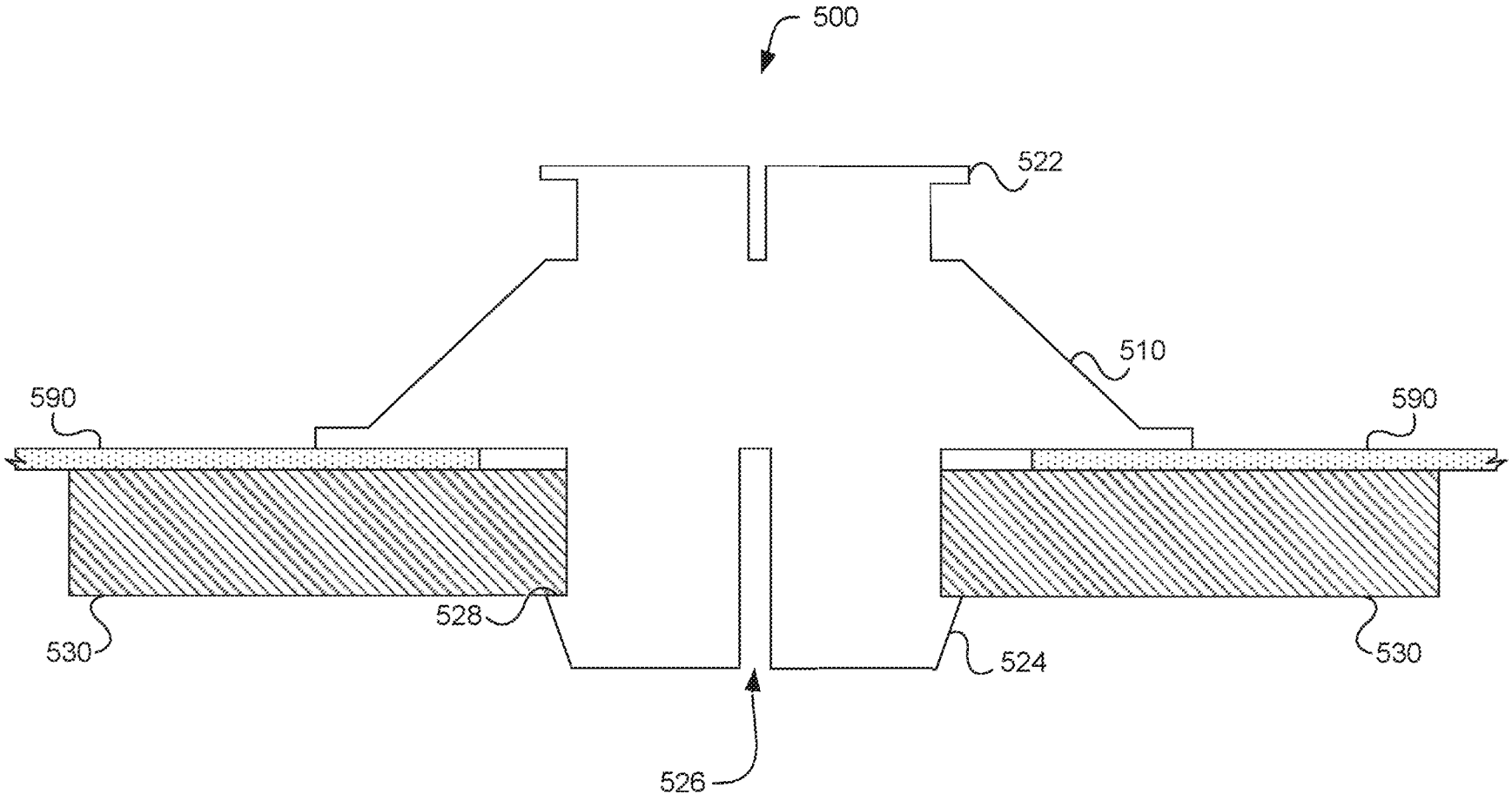
FIG. 5E illustrates a cross-sectional view of an example connector attached to a tankless water heater, in accordance with the present disclosure.

As shown in FIG. 5E, the connector 500 can optionally include a hybrid connector member 540 that is shaped and dimensioned to be a single component that can insert into the aperture of water heater panel 590 and the aperture 532 of the bracing member 530 attach to the bracing member 530 (similar to the connector member 520) and can also cover the aperture of the water heater panel 590 (similar to the cover plate 510).

The connector 500 can also include a gasket or other seal to form a watertight and/or airtight seal (or substantially watertight and/or airtight steal) with the tankless water heater. The gasket can be placed between the cover plate 510 and the tankless water heater. Alternatively, or additionally, the connector 500 can have an adhesive layer disposed between the cover plate 510 and the tankless water heater (e.g., on an underside of the cover plate 510). The adhesive layer can include an adhesive to fasten the cover plate 510 to a surface of the tankless water heater. The adhesive layer could also include a material to increase the coefficient of friction of the cover plate 510 to prevent the cover plate 510 from moving. The gasket and/or adhesive layer can also serve to compress and/or expand during or after attachment of the connector member 520 to the bracing panel 530, such that the gasket and/or adhesive can act as a buffer to compensate for differences in wall thickness of various water heater makes and/or models.

The connector 500 can have an unsecured state and a secured state. In the secured state, the adhesive layer can prevent the cover plate 510 from moving. In the unsecured state, however, when the cover plate 510 is not engaged with the adhesive layer, the connector 500 can move radially until the connector member 520 abuts the perimeter of the air inlet in the tankless water heater. In such a manner, the connector 500 can be positioned in a variety of orientations within the air inlet of the tankless water heater to properly align with existing piping and/or ventilation. Alternatively, the connector 500 can be initially attached to, and positioned on, a water heater without adhesive, and subsequent to placing the connector 500 in the desired location and/or position, the connector 500 can be secured to the water heater such as by taping or otherwise adhering the cover plate 510 to the exterior of the water heater.

Figure 6A:
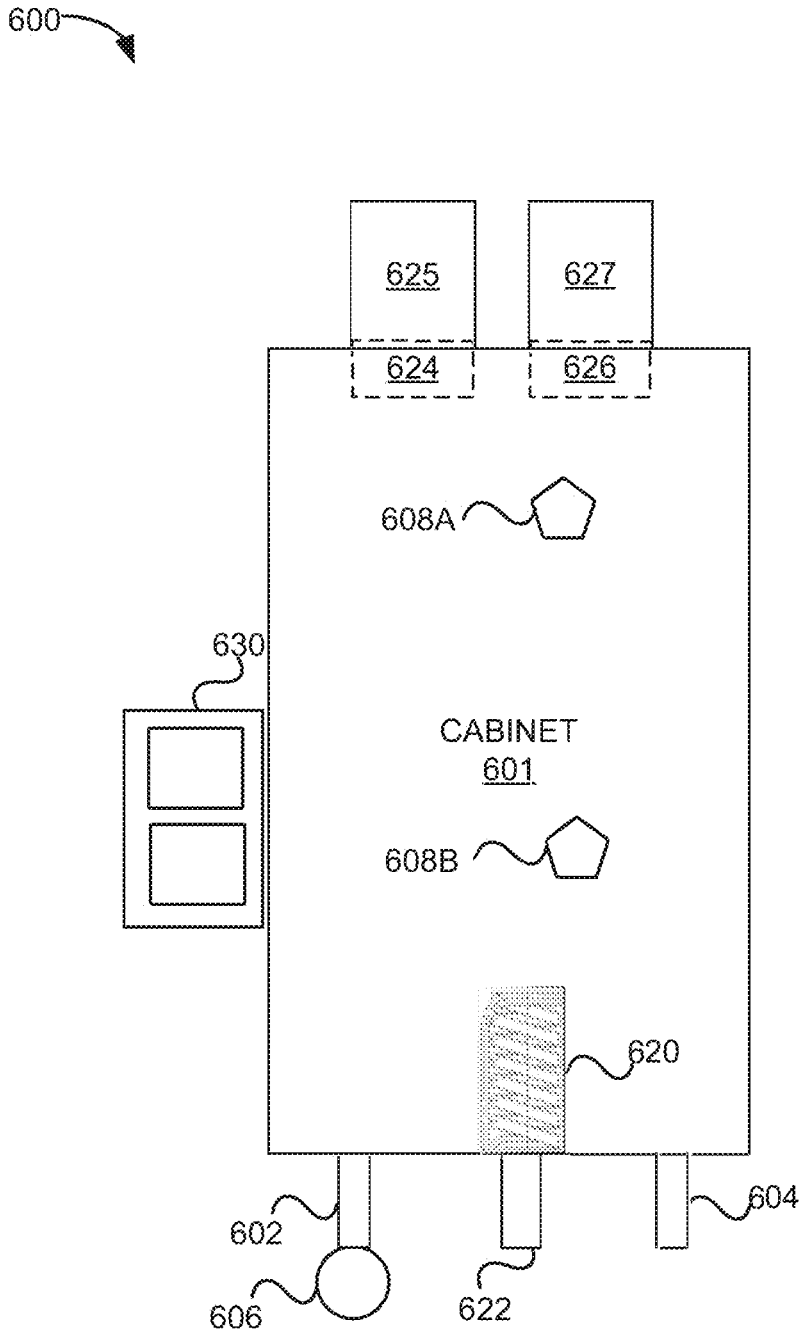
FIG. 6A illustrates a schematic diagram of a tankless water heater used with connectors, in accordance with the present disclosure.

FIG. 6A is a schematic view of a tankless water heater 600 that includes a cabinet 601, a fluid inlet 602, a fluid outlet 604, a flow sensor 606, a temperature sensor (e.g., one or both of temperature sensors 608A, 608B), a combustion chamber 620 having a fuel inlet 622, an air inlet 624 connectable to an air inlet vent 625, and an exhaust conduit 626 connectable to an exhaust vent 627, and a controller 630. It is understood that FIG. 6 is provided to illustrate a tankless water heater to be used with the connectors described herein and that the various components of the tankless water heater 600 can be arranged in various orders, locations, and configurations.

As shown, FIG. 6A depicts a combustion chamber 620, which can be used to facilitate a heat exchange between hot combustion gases and unheated water. The combustion chamber 620 can have a fuel inlet 622 and an air inlet 624 to facilitate a combustion reaction. Spent combustion gases can be expelled via the exhaust conduit 626 once they have cooled.

The air inlet 624 and/or the exhaust conduit 626 can connect the tankless water heater to existing piping through any of the connectors described herein. In fact, the connectors described herein can ensure a smooth connection between the tankless water heater 600 and any existing air circulation system. As such, when the combustion chamber 620 (and corresponding components) is dissimilar or a different design than the existing piping, the connectors described herein can provide for a dynamic connection to a variety of fitments.

Figure 6B:
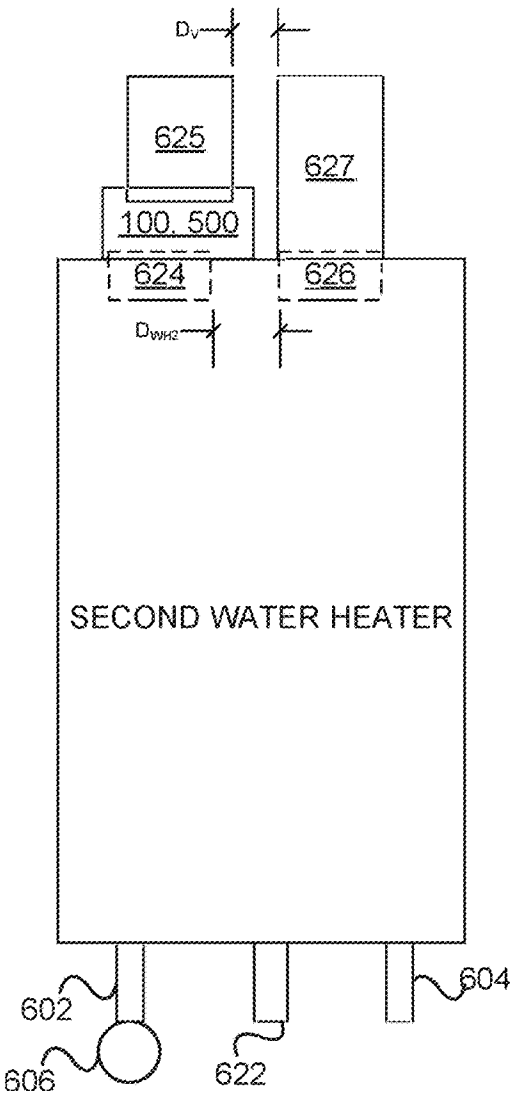
FIG. 6B illustrates a schematic diagram of two tankless water heaters having dissimilar vent distances used with connectors, in accordance with the present disclosure.
Figure 6B:
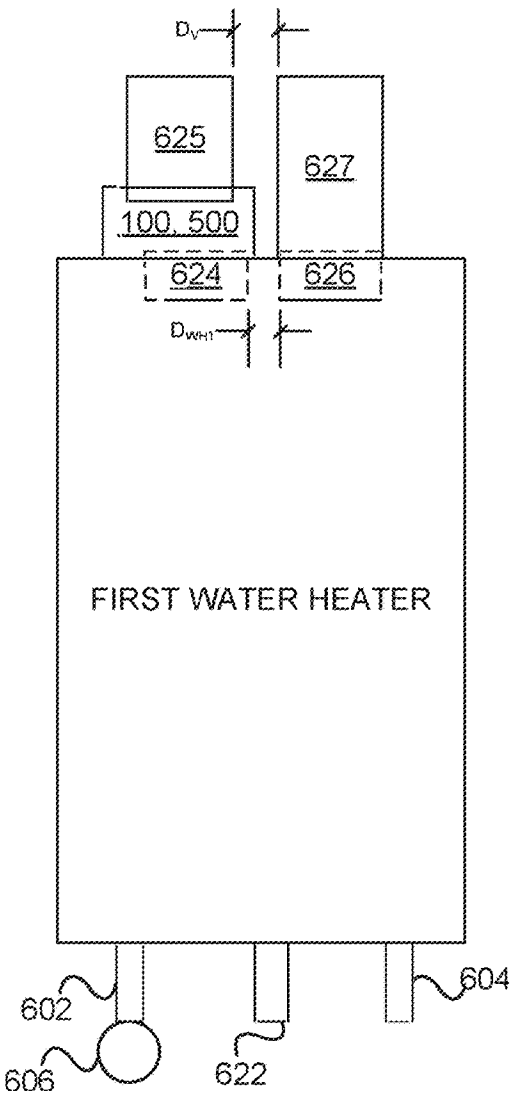

Referring to FIG. 6B, a schematic illustrating the versatility of the disclosed technology is provided. As shown, the disclosed technology (e.g., any one of the connectors described herein), which is indicated as connector 100, 500, can accommodate the installation of different makes and models of water heaters without the need for rerouting an air intake vent 625 or an exhaust vent 627. For example, as shown the existing air intake vent 625 and exhaust vent 627 can have a vent distance Dv between them, a first water heater can have a first distance $D_{WH1}$ between its air inlet 624 and exhaust conduit 626, and a second water heater can have a second distance $D_{WH2}$ between its air inlet 624 and exhaust conduit 626. Nonetheless, either the first water heater or the second water heater can be connected to the existing air intake vent 625 and exhaust vent 627 without rerouting, replacement, or other modifications to the air intake vent 625 and exhaust vent 627. That is, the connector 100, 500 can accommodate both the different first distance $D_{WH1}$ and second distance $D_{WH2}$, while the vent distance Dv remains the same.

Although commonly referred to as tankless water heaters, such water heaters often use some form of small storage tank in which to heat the water. The low fluid capacity heating chamber can be contained within the cabinet 601 can be used as a temporary storage location for the combustion chamber 620 to add heat to the water. The low fluid capacity heating chamber can be sized for various applications. For example, the low fluid capacity heating chamber can have a capacity of fifteen gallons or less for a typical usage application. As another example, the low fluid capacity heating chamber can be sized between one and two gallons for use with a bathroom sink in a user's home, as based on the average user's demand for hot water. Depending on the application, the low fluid capacity heating chamber can have a capacity of 0.25 gallons, 0.5 gallons, 1 gallon, 1.5 gallons, 2, gallons, 2.5 gallons, 3 gallons, 3.5 gallons, 4 gallons, 4.5 gallons, 5 gallons, or any other appropriate size to fit the particular application. For example, the low fluid capacity heating chamber can have a capacity of ten gallons, fifteen gallons, or more.

The low fluid capacity heating chamber can be sized to meet Department of Energy (DOE) conservation standards for consumer water heaters. For example, the low fluid capacity heating chamber can be less than 2 gallons to meet DOE standards for electric instantaneous water heaters found in 10 C.F.R. 430.32(d). The low fluid capacity heating chamber can be made of any suitable material for storing and heating water, including copper, carbon steel, stainless steel, ceramics, polymers, composites, or any other appropriate material.

Furthermore, the low fluid capacity heating chamber can be treated or lined with a coating to prevent corrosion and leakage. An appropriate treating or coating will be capable of withstanding the demand temperature of the heated water and pressure of the system and can include, as non-limiting examples, glass enameling, galvanizing, thermosetting resin-bonded lining materials, thermoplastic coating materials, cement coating, or any other appropriate treating or coating for the application. Optionally, the low fluid capacity heating chamber can be insulated to retain heat. For example, the low fluid capacity heating chamber can also be insulated using fiberglass, aluminum foil, organic material, or any other appropriate insulation material.

The tankless water heater 600 can include various sensing devices that collect data about the water in the system. FIG. 6 shows a flow sensor 606 and temperature sensors 608A, 608B. The flow sensor 606 is shown as being installed just downstream of the fluid inlet 602 but can be installed in alternative locations that are in fluid communication with the low fluid capacity heating chamber 601. For example, the flow sensor 606 can be installed just downstream of the fluid inlet, inside the low fluid capacity heating chamber, downstream of the low fluid capacity heating chamber, or even upstream of the fluid inlet 602 or downstream of the fluid outlet 604 so long as the flow sensor 606 is able to detect a positive flow (fluid flowing through the low fluid capacity heating chamber in the direction from the fluid inlet 602 and toward the fluid outlet 604) of a fluid flowing into the low fluid capacity heating chamber.

Similar to the flow sensor 606, the temperature sensor(s) 608A, 608B can be installed in any appropriate location that allows the temperature sensor(s) 608A, 608B to detect temperature data of fluid at the installed location of the temperature sensor(s) 608A, 608B. Although two temperature sensors 608A and 608B are shown in FIG. 6, the tankless water heater 600 can include only a single temperature sensor. For example, the tankless water heater 600 can include only temperature sensor 608A to measure the temperature of the fluid within the low fluid capacity heating chamber, or the tankless water heater 600 can include only temperature sensor 608B to measure the temperature of the fluid exiting the low fluid capacity heating chamber.

The temperature sensor(s) 608A, 608B can be any type of sensor capable of measuring temperature of a fluid and providing temperature data indicative of the fluid temperature to the controller 630. For example, the temperature sensor(s) 608A, 608B can be thermocouples, resistor temperature detectors, thermistors, infrared sensors, semiconductors, or any other type of sensors which would be appropriate for a given use or application. All temperature sensors of the system can be the same type of temperature sensor, or the system can include different types of temperature sensors. For example, temperature sensor 608A can be a thermocouple and temperature sensor 608B can be a thermistor. One skilled in the art will appreciate that the type, location, and number of temperature sensors can vary depending on the application.

While various connectors (e.g., connectors 100, 500) are described in relation to a combustion-based gas water heater, it is contemplated that, additionally or alternatively, the connectors can be used with other types of tankless water heaters, such as certain heat pump water heaters.

While the present disclosure has been described in connection with a plurality of example aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

That which is claimed is:

1. A water heater kit comprising:

a tankless water heater comprising:

an air inlet;

an exhaust outlet;

a water inlet;

a water outlet; and a heating chamber in fluid communication with each of the air inlet, the exhaust outlet, the water inlet, and the water outlet; and a vent connector configured to fluidly connect one of the air inlet and the exhaust outlet to a corresponding conduit, the vent connector comprising:

a flange;

an aperture having a first diameter extending through the flange, the aperture being configured to align with one of the air inlet and the exhaust outlet;

two or more fastening holes extending through the flange, the two or more fastening holes comprising elongated slots on opposite sides of the aperture, each of the two or more fastening holes corresponding to a respective hole in an outer surface of the tankless water heater; and a connector portion substantially surrounding the aperture and extending outward from the flange away from the tankless water heater, wherein the elongated slots have a length greater than the first diameter, and wherein the elongated slots are configured to allow the flange to slide laterally over the respective holes in the outer surface.

2. The water heater kit of claim 1, wherein the vent connector further comprises a gasket disposed between the flange and the tankless water heater.

3. The water heater kit of claim 1, wherein the first diameter of the aperture is less than or equal to a second diameter of the air inlet.

4. The water heater kit of claim 1, wherein the aperture is concentric with the flange.

5. The water heater kit of claim 1, wherein the aperture is offset from a center of the flange.

6. The water heater kit of claim 1, wherein the tankless water heater further comprises a combustion chamber contained within the heating chamber, wherein the combustion chamber is configured to heat a fuel/air mixture in the heating chamber.

7. A water heater kit comprising:

a tankless water heater having an air inlet and an exhaust outlet and having a water inlet and a water outlet in fluid communication with one another; and a heating chamber in fluid communication with each of the air inlet, the exhaust outlet, the water inlet, and the water outlet; and a vent connector configured to fluidly connect one of the air inlet and the exhaust outlet to a corresponding conduit, wherein the vent connector comprises a flange having (i) an aperture which extends through the flange and is configured to align with one of the air inlet and the exhaust outlet, the aperture having a first diameter; and (ii) two or more fastening holes which extend through the flange, which are disposed on opposite sides of the aperture, which correspond to a respective hole in an outer surface of the tankless water heater; and a connector portion substantially surrounding the aperture and extending outward from the flange away from the tankless water heater, wherein two of the two or more fastening holes are elongated slots parallel to each other, each of the elongated slots having a length greater than the first diameter, and wherein the elongated slots are configured to allow the flange to slide laterally over the respective holes in the outer surface.

8. The water heater kit of claim 7, wherein the vent connector further comprises a gasket disposed between the flange and the tankless water heater.

9. The water heater kit of claim 8, wherein the first diameter of the aperture is less than or equal to a second diameter of the air inlet.

10. The water heater kit of claim 8, wherein the aperture is concentric with the flange.

11. The water heater kit of claim 8, wherein the aperture is offset from a center of the flange.

12. The water heater kit of claim 8, wherein the tankless water heater further comprises a combustion chamber contained within the heating chamber, wherein the combustion chamber is configured to heat a fuel/air mixture in the heating chamber.

* * * * *